United States Patent [19]

Thayer

[11] Patent Number: 4,931,687

[45] Date of Patent: Jun. 5, 1990

[54] SPARK GAP SWITCH HAVING A TWO-PHASE FLUID FLOW

[75] Inventor: William J. Thayer, Kent, Wash.

[73] Assignee: Spectra-Physics, Inc., San Jose, Calif.

[21] Appl. No.: 257,286

[22] Filed: Oct. 12, 1988

[51] Int. Cl.[5] ..... H01J 1/08; H01J 7/24; H01H 33/82

[52] U.S. Cl. ..... 313/231.01; 313/231.71; 315/111.01; 315/344; 200/148 G

[58] Field of Search ..... 313/231.01, 231.11, 313/231.21, 231.71; 315/111.01, 111.11, 111.81, 344; 200/148 G

[56] References Cited

U.S. PATENT DOCUMENTS

| | | | |
|---|---|---|---|
| 4,027,187 | 5/1977 | Rabe | 313/231.01 X |
| 4,077,020 | 2/1978 | Anderson et al. | 313/231.01 X |
| 4,237,404 | 12/1980 | Limpaecher | 315/111.01 |
| 4,360,763 | 11/1982 | Gryzinski | 313/231.01 X |
| 4,563,608 | 1/1986 | Lawson et al. | 313/231.71 |

*Primary Examiner*—Donald J. Yusko
*Assistant Examiner*—Sandra L. O'Shea
*Attorney, Agent, or Firm*—Seed and Berry

[57] ABSTRACT

A two-phase fluid is injected into a volume upstream of the spark gap flow channel of a spark switch. The injected two-phase flow can be separated, causing the liquid component of the two-phase fluid to form a layer adjacent the wall of the flow channel and a predominately gas phase region near the spark switch electrodes. This distribution of liquid and gas phases can be achieved by tangential injection of the two-phase fluid. The resulting two-phase flow absorbs the thermal and radiant energy produced by the spark in the spark channel, as well as the energy of the shock wave systems produced by the spark in the spark channel, thereby reducing the temperature that the wall of the spark gap would attain without such two-phase fluid flow injection. Vaporization of the liquid due to this energy absorption generates a substantial gas flow which increases the purge flow and recovery rate of the spark gap switch. The spark gap switch flow channel and the expansion duct to which the spark switch is attached, can be tuned to produce an unsteady purging flow through the spark channel, thereby rapidly removing the hot gas residues caused by the preceding spark from the spark channel and restoring the pressure and density in the spark gap to the initial levels. In one embodiment, the two-phase fluid can be a mixture of water droplets and steam.

14 Claims, 5 Drawing Sheets

SPARK GAP SWITCH HAVING A TWO-PHASE FLUID FLOW

TECHNICAL FIELD

This invention relates to electrical switches, and more particularly, to a spark gap switch having a two-phase fluid flow.

BACKGROUND ART

Spark gaps can operate as switches to control the flow of very large electrical currents under very high voltage conditions. Typical applications include accelerators, high-power gas laser systems, and other pulsed power systems. Spark gaps operate to prevent the flow of electrical current in high voltage applications by filling the space between a pair of electrodes with an insulating gas. The electrodes are held in fixed position relative to one another by a solid dielectric material that is part of the spark switch walls.

When current flow is desired, a trigger pulse on an intermediate electrode or some other means is used to locally change the state of the insulating gas and thus create a more conductive path. The lower resistance locally leads to a rapid breakdown of the gas between the electrodes at approximately the hold-off voltage. The breakdown very rapidly produces a very low resistance conduction path, i.e., a spark or arc, through the insulating gas and transfers a high energy electrical pulse to a load.

Losses in the spark release large amounts of energy in various forms during each pulse. Besides the light energy produced by the spark, significant amounts of thermal energy are also produced. In addition, the rapid temperature and pressure change of the gas in the spark results in a series of very strong shock and expansion waves that propagate outwardly from the spark gap.

Before the spark gap has recovered and can hold the high voltage of another high-energy pulse, the gas between the electrodes must be returned to approximately its initial state or replaced with fresh gas. One way to rapidly restore the density and resistance of the gas in the spark gap is to introduce a purge flow in a flow channel which sweeps the hot residue produced by preceding sparks downstream and introduces a new charge of the gas into the spark gap and adjacent regions. This necessitates controlling the resulting pressure waves to simultaneously restore the density of the fresh purge gas at the spark gap to the original density. While such methods are effective, they can require a great deal of power to circulate the purge gas flow at high pulse repetition frequencies.

Another problem results since the light, heat, and shock waves produced in the spark channel are radiated toward the interior spark gap switch walls. Typically, the exterior spark switch walls are cooled, such as by liquid cooling, which passes through cooling passages within the solid dielectric or on its exterior. Therefore, the large temperature differential between interior and exterior spark switch walls creates significant mechanical stresses in the walls, often resulting in their mechanical failure as the spark gap is operated at high pulse repetition rates.

Conventional approaches to the problem of clearing the spark gap are described in U.S. Pat. Nos. 4,027,187, 4,077,020, 4,237,404, 4,360,763, and 4,563,608.

It is therefore desirable to have a spark gap switch that can operate efficiently and reliably for long periods of time and at higher power levels and pulse repetition frequencies, without requiring significant power input to circulate a purge gas and without subjecting the spark gap switch walls to high thermal/mechanical stresses.

DISCLOSURE OF THE INVENTION

It is an object of the present invention to provide a spark gap switch that establishes a circulating, two-phase fluid flow in the spark gap flow channel to reduce the spark energy that reaches the interior spark switch walls.

It is another object of the present invention to provide a spark gap switch that establishes a circulating, two-phase fluid flow in the spark gap flow channel to remove energy from the interior spark gap walls.

It is still another object of the present invention to provide a spark gap switch that establishes circulating two-phase fluid flow which aids in purging the spark channel of the spark switch.

It is yet another object of the present invention to provide a spark gap switch that establishes an unsteady fluid flow in order to mix heated spark channel gases with cooler flow channel gases.

It is a still further object of the present invention to provide a method for purging a spark gap flow channel which reduces the amount of thermal and radiant spark energy that impinges an interior spark switch wall.

It is an even further object of the present invention to provide a method for purging a spark gap flow channel which quickly removes absorbed heat from an interior spark switch wall.

It is another object of the invention to provide a method for maximizing the overall efficiency of a spark gap switch by minimizing the electrical losses in the switch and also minimizing the flow power required to circulate the purge gas through the spark gap.

Still another object of the present invention is to provide a spark gap whose operation does not cause deposition of solid, conductive materials on the interior of the spark gap flow channel.

A further object of the present invention is to provide fast, repeatable, and full recovery of the spark gap hold-off voltage and to simultaneously use the pressure waves and unsteady flow caused by the spark to augment the spark gap purging and recovery process.

An additional object of the present invention is to convert some of the energy which is dissipated in the spark gap directly into flow energy to help purge the spark gap and reduce the power which must be input externally to circulate the purge fluid through the spark gap switch and associated equipment.

An even further object of the present invention is to provide that all of the above-mentioned objects can be achieved simultaneously through the proper selection of spark gap casing and flow channel configuration, purge fluid species and phases, and the distribution of the phases of the purge fluid flowing through the spark gap switch.

According to one aspect, the invention provides a spark gap switch for transferring electrical energy from a source to a load in a series of sparks. The spark gap switch comprises a spark gap flow channel having two electrodes for supporting a series of sparks therebetween, a dielectric housing for holding the electrodes in proper alignment, at a desired spacing, and confining the die electric purge fluid, and inlet and outlet ports for admitting a flowing purge fluid to and exhausting the flowing purge fluid from the spark gap electrode region. One electrode is connected to the electrical energy source and the other electrode is connected to the load. The spark gap switch further comprises a tuned flow channel, defined by the dielectric housing interior walls and adjacent the flow channel, for producing a tuned, unsteady flow of the purge fluid through the spark gap in response to each spark produced by the spark gap switch to simultaneously maximize purging of hot residues and recovery of pressure and density at the electrodes. The spark gap switch further comprises means for injecting a two-phase fluid tangentially or axially to the spark gap flow channel, the two-phase fluid having components of two different densities so that a circulating flow of the two-phase fluid is generated in the spark gap flow channel, with the denser component of the two-phase fluid established adjacent the wall of the spark gap.

In another aspect, the present invention provides a method for purging a spark channel of a spark gap switch and reducing the amount of the thermal and radiant energy produced in the spark channel that impinges on or is conducted through a wall defining the dielectric housing of the spark gap switch. The method comprises the steps of generating a two-phase fluid having liquid and gaseous components with two different densities, the liquid component being the more absorptive of the thermal and radiant energy produced by the spark channel, and able to absorb thermal energy through evaporative phase change, injecting the two-phase fluid tangentially or axially to the spark gap flow channel walls, producing a generally circulating flow of the two-phase fluid in the spark gap, the liquid component being more closely positioned toward the wall, the liquid having higher heat transfer rates for convective and boiling heat transfer and higher heat capacity due to evaporative phase change than a gas for removing absorbed energy from the wall, producing a series of sparks in the spark channel, and generating an unsteady pressure wave system in the spark channel in response to the series of sparks, the unsteady flow simultaneously purging the spark channel and restoring gas pressure and density before the occurrence of the next spark in the spark gap.

BEST MODES FOR CARRYING OUT THE INVENTION

Figure 1A:
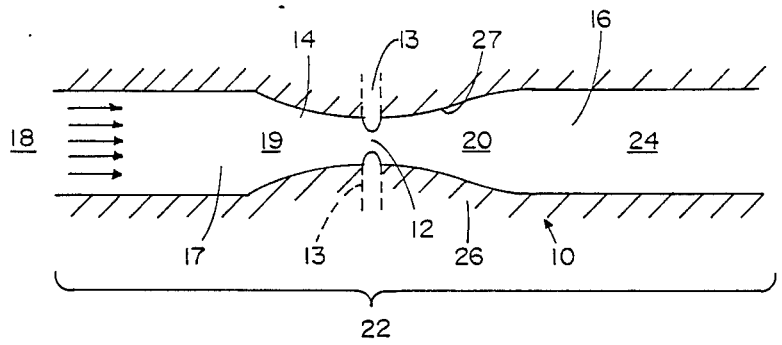
FIG. 1A PRIOR ART
FIG. 1A is a schematic diagram of a prior art gas spurged spark gap switch for high pulse repetition rate applications, shown in elevational view.
Figure 1B:
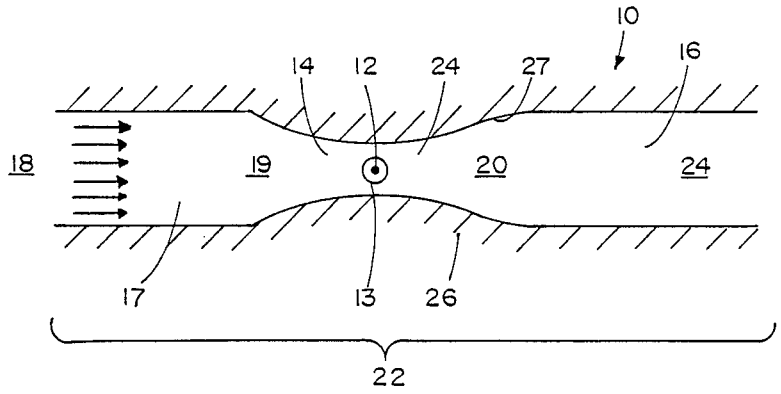
FIG. 1B PRIOR ART
FIG. 1B is a plan view of the spark gap switch of FIG. 1A.

Referring to the schematic diagrams of FIGS. 1A and 1B, a prior art flow purged spark gap switch 10, including an inlet 14 to the spark gap 12, and an outlet shown generally by numeral 16, periodically includes a spark or arc at the spark gap 12. The spark gap 10 includes two electrodes 13 defining the spark gap height — one connected to a source of electrical energy and the other connected to the load intended to receive the electrical energy from the source — built into a solid dielectric housing 26. The flow channel 16 is defined by a dielectric housing interior wall 27 and extends generally between a fluid supply inlet end 17 and the exhaust duct 24. The spark gap switch 10 is swept by a flow of a purge fluid (e.g., a gas) from a fluid supply line 18 at the inlet end 17, through a converging region of nozzle 19, through the spark channel 12 and via flow channel 16 through an expansion duct or diffuser 20 and exhaust duct 24. The gas supply line 18, duct 24, and spark gap switch 10 constitute a flow channel 22.

In the configuration of FIGS. 1A and 1B, gas with desired dielectric properties flows from a moderately high pressure source and enters the flow channel 22 through the flow fluid supply line 18. The gas flows through the area of the nozzle 19 before reaching the area near the spark gap 12. When a spark is produced in the spark gap 12, strong shock and expansion pressure waves propagate in a relatively unimpeded manner upstream and downstream of the spark gap 12, causing large amplitude unsteady flows which disrupt the purge flow. The passage area changes partially reflect the resulting shock and expansion waves generated by the spark back toward the spark channel 12 and downstream toward the expansion duct 20, and visa versa.

A description of an alternative spark gap switch is given in copending U.S. Pat. application 07/256,430 entitled "Apparatus and Method for Tuned Unsteady Flow Purging of High Pulse Rate Spark Gaps," by the applicant of the present application, and assigned to the U.S. Dept. of Energy.

Figure 2:
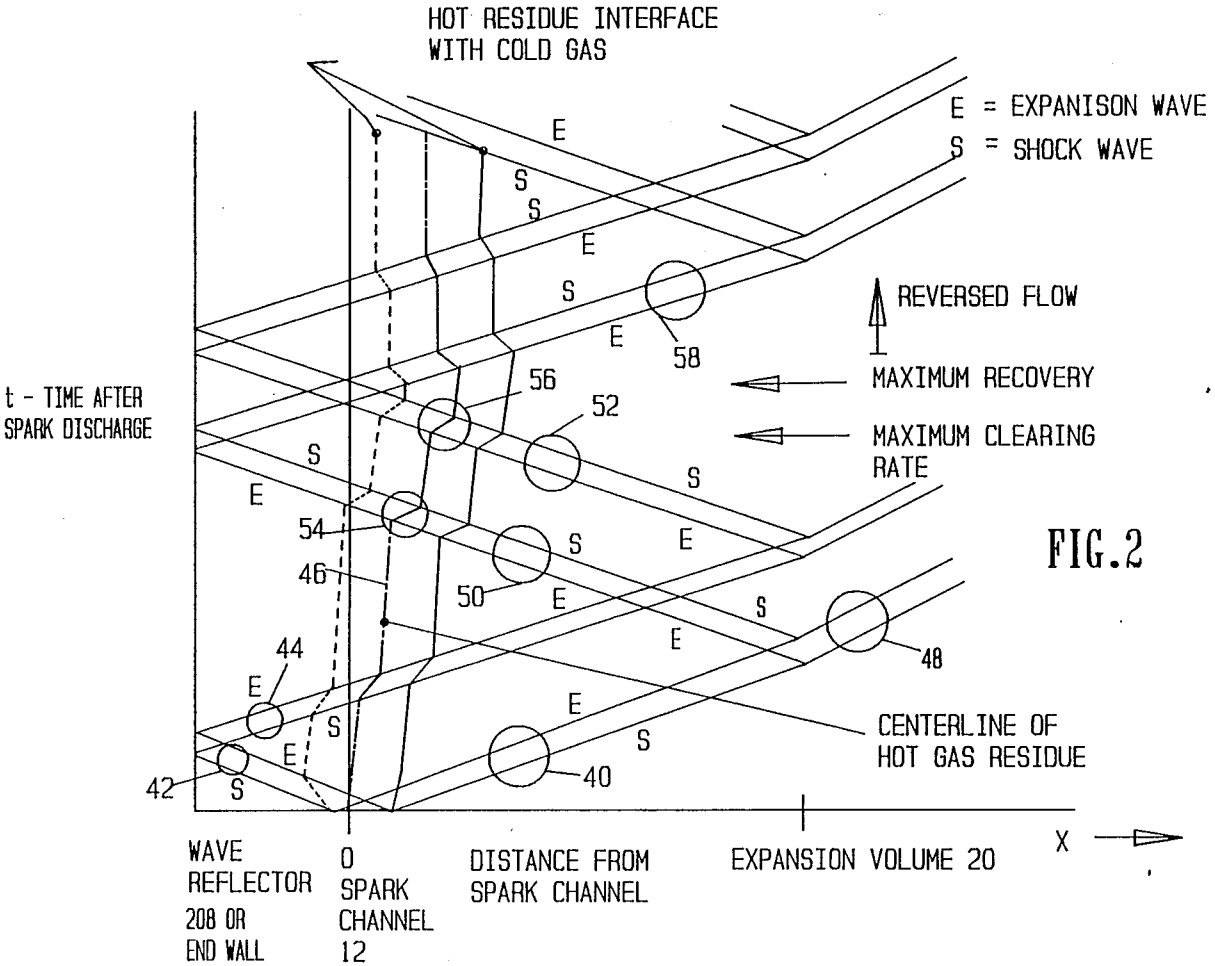
FIG. 2 is a position-time graph of the unsteady flow in the spark switches shown schematically in FIGS. 3, 6, and 7.

The wave diagram of the position-time graph of FIG. 2 shows the trajectories of shock (or compression) and expansion waves in a hot gas generated by the spark in the spark gap 12. It illustrates the use of a shock wave reflector plate 208 in FIGS. 6 and 7 or flow channel wall 28 in FIGS. 3, 4, and 5 to produce shock wave-driven flow in the "downstream" direction (as defined above) and a diffuser and exhaust duct configuration to generate an expansion wave-driven flow, also in the downstream direction. From their initial inception at the location of the spark channel 12, shock and expansion wave pairs 40 and 42 move downstream and upstream, respectively. Shock and expansion wave pair 42 impinges upon and is reflected by the shock wave reflector 208, or an end wall, causing it to travel downstream as wave pair 44. Shortly after being reflected from shock wave reflector 28, wave pair 44 reaches the center line 46 of the hot gas residue from the spark channel 12. The gas residue trajectory is indicated by line 46, which generally moves downstream at the velocity of the purge gas through the flow channel 22, as augmented by the unsteady flow. When wave pair 44 reaches the trajectory of the gas center line 46, the center line 46 accelerates downstream.

When downstream-moving shock and expansion wave pair 40 reaches the location of the diffuser 20, a portion of the waves continues to travel downstream as shock and expansion wave pair 48 at a decreased velocity. A portion of the energy of wave pair 40 is reflected upstream as a compression and expansion wave pair 50. Shortly thereafter, the wave pair 44 reaches the location of the expansion volume 20 and is similarly partially reflected upstream as shock and expansion wave pair 52. Both of the wave pairs 50 and 52 cause the gas center line trajectory 46 to travel downstream at a decreased velocity (at points 54 and 56, respectively).

The trajectory of the center line 46 continues downstream until it is struck by downstream-traveling shock and expansion wave pair 58 produced by the wave pair 50 reflecting from the wave reflector 28, at which point the center line of the hot gas residue has reached its maximum downstream traverse for this spark period. Thereafter, the center line 46 changes direction and begins to move upstream toward the spark channel 12. However, the center line 46 does not reach its original location at the spark channel 12 because of the average flow, and, accordingly, the spark channel 12 is free of residue gases when the next spark occurs at the spark channel 12.

Figure 3:
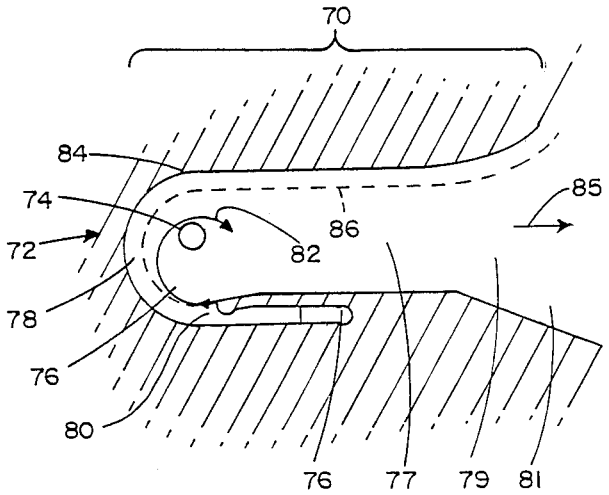
FIG. 3 is a schematic diagram of a cross-sectional plan view of a first embodiment of the spark gap switch of the present invention, showing the flow channel.

Referring now to FIG. 3, a spark gap switch 70 comprises electrodes (not shown), a housing, flow channel 72 which includes a spark gap 74, an inlet 76, and a constant area flow duct 77, designated generally by numeral 78 and defined by wall 84. In a preferred embodiment of the linear configuration of this invention, the length of the substantially constant area flow duct 77 and diffuser 79, and the divergence angle and shape of the diffuser 79 will be configured to achieve a tuning of the pressure waves and associated unsteady flow to simultaneously provide maximum purging of the hot spark residue and restoration of the pressure and density of the fresh purge gas at the time of subsequent spark pulses. The flow channel 77 could also be configured so that tuning was not achieved at the operating pulse rate, but only at the expense of larger spark gap switch size to overcome lower recovery of the spark gap hold-off voltage.

In accordance with one embodiment of the present invention, the flow channel 70 further includes injector means 80 which injects a two-phase fluid tangentially into the flow channel 78. As a result of this tangential introduction of fluid, a circulating flow, indicated by arrows 82, is established around the spark gap 74. Gas or additional liquid and droplets are injected by the injector means 80. The circulating flow 82 causes the denser liquid phase of the two-phase fluid (e.g., liquid or droplets and vapor) to be forced toward the wall of the volume 78 by centrifugal force. The centrifugal force establishes a liquid/vapor layer, indicated by broken line 86, adjacent to at least a portion of the wall 84. The gaseous portion of the two-phase fluid remains near the spark gap 74 and the central axis of the flow channel 70.

One appropriate choice for the two-phase fluid described above is water, which has a vapor phase consisting of steam. Other appropriate two-phase fluids are ammonia, and other low molecular weight, easily condensed dielectric gases. Such low molecular weight gases are described in copending U.S. Pat. application Ser. No. 07/256,839 entitled "Improved Spark Gap Switch System With Easily Condensable Dielectric Gas," by the applicant of the present application, and assigned to the U.S. Dept. of Energy.

Since the liquid phase of the two-phase purge fluid absorbs energy more readily than the gas phase, the thermal and radiant energy produced by the spark, as well as the energy in the shock waves produced in the spark channel 74, is partially absorbed by the two-phase layer 86. In addition, liquid which flows on the wall or impinges on the wall due to shock wave action will absorb transmitted energy from the interior wall surface, and evaporate to cool the wall and generate purge fluid. This allows those portions of the walls 84 at which the two-phase layer 86 is positioned to be maintained relatively cool.

The injection means 80 can be a nozzle designed to prevent the shock and expansion waves from the spark from propagating into the fluid supply (not shown) upstream of the spark gap switch 72.

Those skilled in the art will appreciate that the spark gap switch 70 of FIG. 3 will also operate if the tuned channel is omitted and replaced with a conventional steady flow channel.

Figure 4:
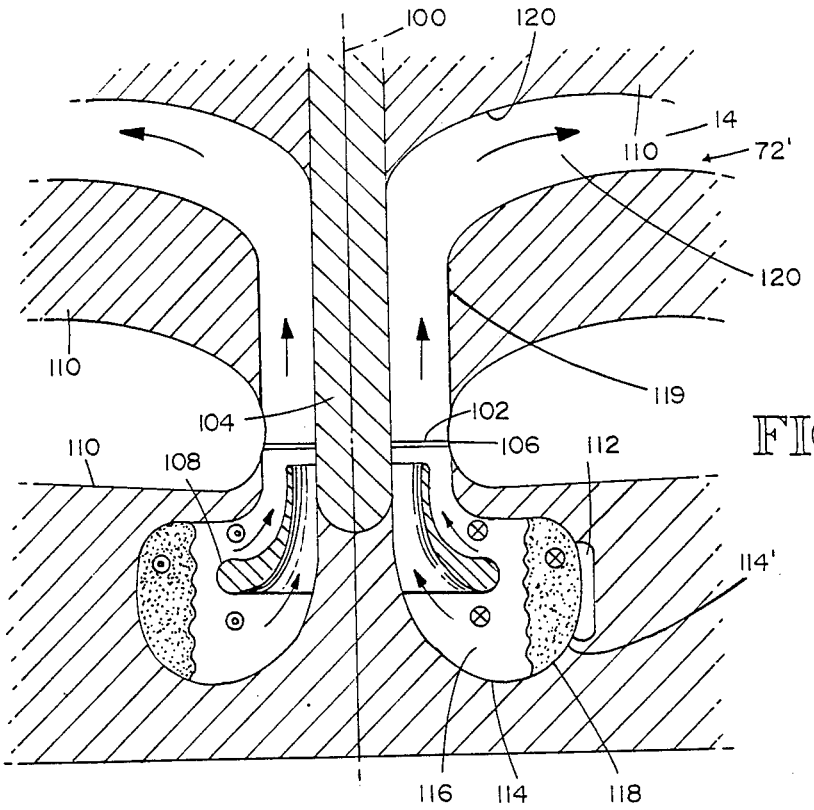
FIG. 4 a schematic diagram of a crosssectional plan view of a second embodiment of the spark gap switch of the present invention, showing the flow channel.
Figure 5:
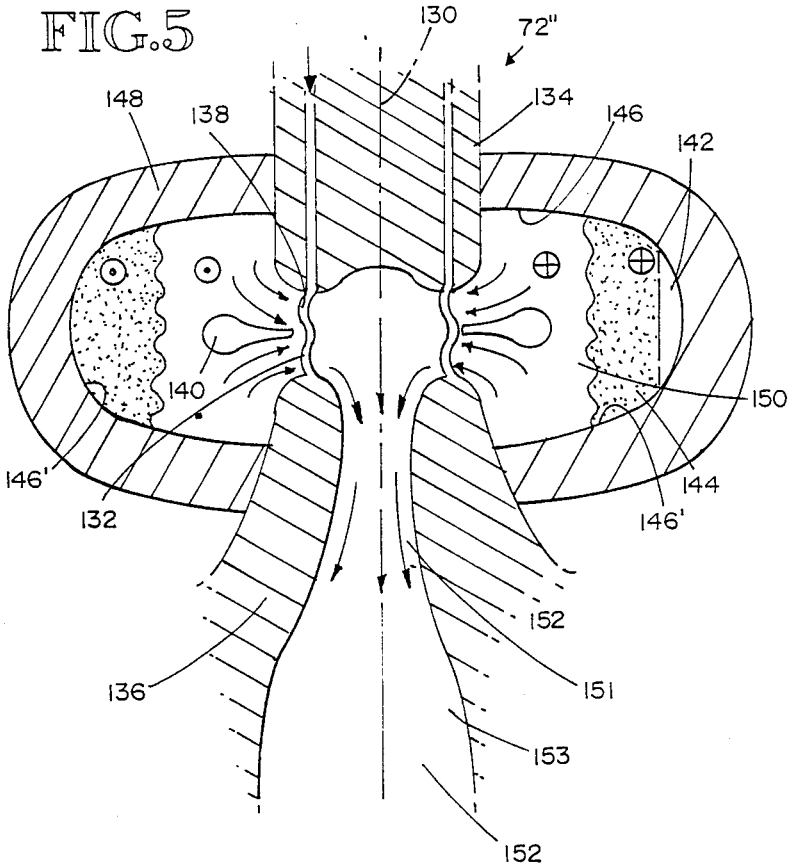
FIG. 5 is a schematic diagram of a cross-sectional plan view of a third embodiment of the spark gap switch of the present invention, showing the flow channel.

FIGS. 4 and 5 are diagrammatic side views of second and third embodiments 72' and 72'', respectively, of the spark gap switch of the present invention. Both of these spark switch configurations are appropriate for much higher pulse energies than the spark gap switch shown in FIG. 3. The spark gap switch 72' of FIG. 4 is rotationally symmetric with respect to central longitudinal axis 100. It produces a radial, annularly shaped spark 102 between a central electrode 104 and an annular electrode 106 thereabout. To assist in the formation of the annular spark 102, a trigger electrode 108 is formed between electrode 104 and electrode 106. Trigger electrode 108 assists in increasing the intensitY of the electric field between it and the electrode 106 in order to facilitate a breakdown of the spark gap switch 72'. The electrodes (i.e., 104 and 106) are electrically isolated from one another by structures 110 made from a dielectric material.

A tangential flow injector 112 injects a two-phase fluid (e.g., a mixture of higher density liquid and droplets and lower density vapor) tangentially with respect to an aerodynamically shaped wall 114 of the solid dielectric material structure 110 that forms an annular flow passage 116. It may be desirable that the two-phase fluid be injected in a plane perpendicular to the axis 100.

The wall 114 that defines the recirculation volume 116, can be cooled in part by a built-in cooling means (e.g., liquid coolant passages formed in the dielectric material 110 forming the walls 114). Therefore, the temperature of the dielectric material 110 will be highest at the wall 114 and will decrease substantially in the direction away from the wall 114. Unless the temperature at the wall 114 can be controlled, mechanical failure resulting from the thermal stresses in the wall 114 will cause the spark gap switch 72' of FIG. 4 to fail prematurely. Accordingly, as a result of the centrifugal action of the circulation flow induced by the tangential flow injector 112, a two-phase layer 118 is formed along the wall 114. The two phase layers 118 is formed from the liquid phase of the two-phase fluid injected through the tangential flow injector 112 and the gas phase which is continuously injected or boiled off from the liquid in layer 118 due to heat emitted by the spark. The layer 118, being composed in part of a liquid phase which can absorb more light, shock wave, and thermal energy from the volume 116 than the gas phase of the two-phase fluid, covers a portion 114' of the walls 114. The portion 114' of the wall 114 that is adjacent the layer 118 will not be subjected to the same energy intensity as the remainder of the wall 114 and, accordingly, will remain cooler. Unsteady flow will draw pulses of the two-phase layer through the spark gap 102 and flow channel to cool the dielectric walls between spark firings.

After passing through the spark gap switch 72', the purge fluid passes through a substantially constant area duct 119 and aerodynamic diffuser 120 positioned downstream of the spark gap 102. Diffuser 120, duct 119, and the volume 116 interact with the shock and expansion wave pairs produced by the annular spark 102 to substantially produce a pulsating purge flow of the two-phase fluid through the constant area duct 119 extending between the annular spark 102 and the diffuser 120. Those skilled in the art of unsteady gas flow will readily appreciate that the diffuser 120, duct 119 , and the volume 116 and the exhaust duct 121 can be "tuned" to produce a series of unsteady pressure waves and flow at the spark channel. This unsteady flow can cause simultaneous clearing and recovery of the spark channel in time for the next spark.

The spark gap switch 72" of FIG. 5 is rotationally symmetric with respect to a central longitudinal axis 130. A spark gap 132 is formed between a cooled cylindrical electrode 134 and the cooled annular electrode 136. The spark formed in the spark gap 132 is an annular spark 138. To assist in initiating the breakdown of the spark gap switch 72", trigger electrode 140 (annular in cross section) is positioned intermediate the electrodes 134 and 136, and is connected electrically to increase the electric field strength between the electrodes 134 and 136 and the trigger electrode 140. A two-phase fluid is injected through a tangential injector 142 in a curved wall 146 of the dielectric material housing 148 which defined an annular flow channel 150. Tangential injection results in the formation of a layer 144 of the liquid and gas phases of the two-phase fluid injected through tangential injector 142. Shock waves, energy radiated directly to the liquid in region 144, and heat transfer of energy absorbed by the breakdown of the spark gap switch 72' The electrodes wall 146' cause phase change of the liquid to generate additional purge gas flow. As explained above in connection with FIG. 4, the layer 144 also promotes cooling of a portion 146' of the wall 146 that the layer is adjacent, thereby reducing the mechanical stress on the dielectric material 148.

The wall 146' and the flow channel 150 are tuned with an aerodynamically shaped tuning channel 151, diffuser 153, and exhaust duct 152 to form a resonance between the shock and expansion wave pairs initiated by the annular spark 138 to produce an unsteady flow of the flow fluid through the spark gap 132 to exhaust duct 152. When the flow channel 150, 151, 153 and the exhaust duct 152 are properly tuned, the spark channel 132 will be cleared of the hot residue gases from the last preceding spark pulse by the unsteady flow and simultaneously restored to the initial pressure and gas density, thereby permitting efficient high pulse repetition frequency and/or higher power operation from the spark gap switch of FIG. 5.

Figure 6:
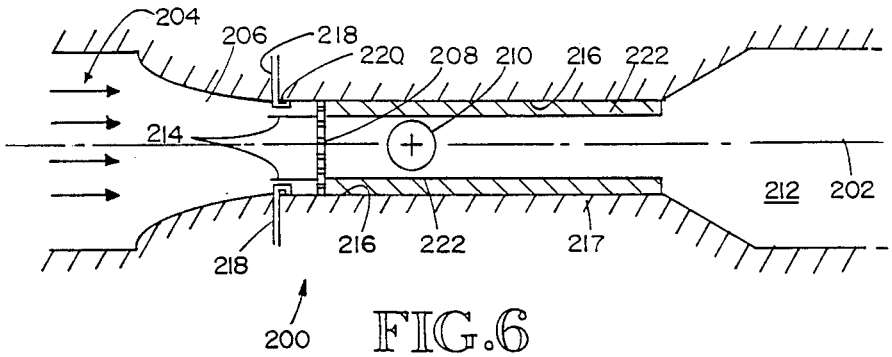
FIG. 6 is a schematic diagram of a cross-sectional view of a fourth embodiment of the spark gap switch of the present invention.

A cross-sectional view of a fourth embodiment of the present invention is shown in FIG. 6. The spark gap switch 200 of FIG. 6 is disposed linearly along a linear axis 202. A particular feature of the spark gap switch 200 is that it has separate gas and two-phase flow regions. Another feature of the spark gap switch 200 is that it utilizes an axial flow configuration. The gaseous, or vapor, phase is introduced separately at inlet 204. The gaseous phase passes through the spark gap switch 200, by passing through the converging region 206, past a wave reflector 208 (of the sort described above), beyond the spark gap 210, and to the diffuser 212. Immediately upstream of the wave reflector 208 is located a pair of flow dividers 214, which separate the gas phase introduced at the inlet 204 from the liquid phase of the purge fluid. The liquid phase is introduced adjacent the wall 216 of the spark gap housing 217 by one or more liquid spray injectors 218 having nozzles 220 directed in a downstream direction. Because of their proximity to the wall 216, the injectors 218 produce a layer 222 of mixed liquid and gas adjacent the wall 216.

Figure 7:
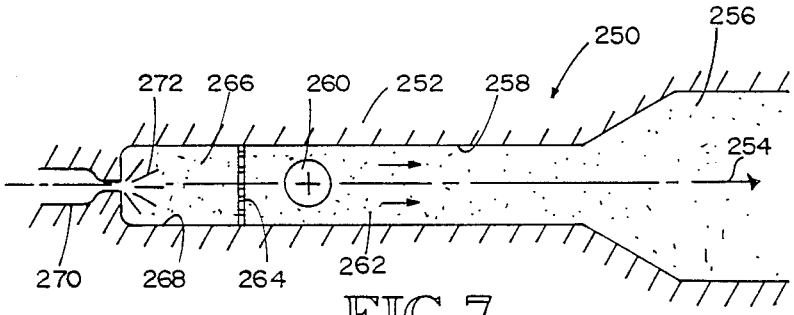
FIG. 7 is a schematic diagram of a cross-sectional view of a fifth embodiment of the spark gap switch of the present invention.

FIG. 7 is a schematic diagram of the cross-section of a fifth embodiment of the spark gap switch of the present invention. The spark gap switch 250, which includes a spark gap housing 252, is symmetric about an axis 254. The spark gap switch 250 includes a diffuser 256, defined by the wall 258. The spark channel 260 can be located centrally within the tuned unsteady flow channel 262. A wave reflector 264 is placed upstream of the spark channel (which includes electrodes that are not shown in FIG. 7). The fluid passing through the wave reflector 264 is produced in a chamber 266, upstream of the wave reflector 264. The wall 268 of the chamber 266 includes a hole for admitting an injector nozzle 270, which is adapted to produce a spray 272 from a liquid phase purge fluid, some of which flashes to the gas phase due to the change of state across the injector nozzle. The source (not shown) of the liquid phase purge fluid is attached to the injector nozzle 270. The spark gap switch 250 produces a well-mixed combination of the two phases of the purge fluid in the chamber 266. This combination passes through the wave reflector 264, past the spark channel 260, and into the diffuser 256.

The best modes of the invention have been explained in the context of a high-power, high pulse rate switch. One skilled in the art will readily appreciate that the spark gap switch can be used in other applications requiring the switching of large amounts of electrical power between two electrodes. Another common example is an accelerator.

While various embodiments of the spark switch of the present invention have been described above, one skilled in the art will readily appreciate that various modifications of the above-described embodiments may be made without departing from the spirit and the scope of the invention. Accordingly, the spirit and the scope of the present invention are to be limited only by the following claims.

I claim:

1. A spark gap switch for transferring electrical energy from a source to a load in a series of sparks, comprising:

a pair of electrodes, a dielectric housing, a purge gas inlet and outlet, a flow channel, defined by a wall and adjacent the spark gap, duct, diffuser and exhaust duct, for producing a flow of a fluid from the inlet through the spark gap in response to each spark produced by the spark switch; and means for injecting a two-phase purge fluid having liquid and gaseous phase components of two different densities generally tangentially to the wall of the source region to generate a circulating flow of the two-phase fluid in the spark gap along the wall, with the liquid component of the two-phase fluid preferentially adjacent to the wall.

2. The spark gap switch of claim 1 wherein the two-phase fluid is a mixture of liquid or droplets and vapor (gas), the droplets being denser than the vapor.

3. The spark gap switch of claim 2 wherein the droplets are more absorptive of the radiant and thermal energy produced by the series of sparks in the spark switch than the vapor, have a higher heat transfer rate, and higher heat capacity through phase change than a gas, thereby preventing at least a portion of the radiant and thermal energy from reaching the wall of the spark gap and quickly absorbing energy which reaches the wall.

4. The spark gap switch of claim 1 wherein the two-phase fluid is a mixture of water droplets and steam.

5. The spark gap switch of claim 1 wherein the spark gap switch further comprises tuned unsteady purge flow channel connected to an exhaust duct connected to the spark switch.

6. The spark gap switch of claim 5 wherein the flow channel is shaped to produce a series of unsteady pressure waves at the spark switch for purging the spark channel and restoring the pressure and density of the fresh purge fluid before the occurrence of the next spark in the spark channel.

7. The spark gap switch of claim 1 wherein the wall of the spark gap switch is formed from a dielectric material.

8. The spark gap switch of claim 1 wherein the means for injecting the two-phase fluid into the switch flow channel function injects the two-phase fluid in a plane generally tangential to a line from the spark gap to the spark switch.

9. The spark gap switch of claim 8 wherein the spark gap switch flow channel has a rotational axis of symmetry that passes through the spark gap, the means for injecting the two-phase fluid in a plane generally perpendicular to the axis.

10. A method for purging a spark gap of a spark gap switch and reducing the amount of the thermal and radiant energy produced in the spark that impinges a wall defining a volume of the spark gap switch and removing absorbed energy in a manner which does not create high thermal /mechanical stresses, the method comprising the steps of:

(a) generating a two-phase fluid having liquid and gaseous components with two different densities, the denser fluid component absorbing a portion of the thermal and radiant energy impinging thereon produced by the spark;

(b) injecting the two-phase fluid generally tangentially to the wall of the flow channel to produce a generally circulating flow of the two-phase fluid in the flow channel, with the denser fluid component being disposed more closely toward the wall than the less dense fluid component;

(c) producing a series of sparks in the spark channel; and (d) generating an unsteady shock wave system in the spark channel in response to the series of sparks, the unsteady pressure wave system aiding the purging of the spark channel and restoring of initial pressure and density before the occurrence of the next spark in the spark channel.

11. The method of claim 10 wherein the two-phase fluid is injected in step (b) in a plane perpendicular to a line from the volume to the spark channel.

12. A spark gap switch for transferring electrical energy from a source to a load in a series of sparks, comprising:

a pair of electrodes, a dielectric housing, a purge gas inlet and outlet, a tuned unsteady flow channel, defined by a wall and adjacent the spark gap, tuning duct, diffuser and exhaust duct, for producing an unsteady flow of a fluid from the inlet through the spark gap in response to each spark produced by the spark switch; and means for injecting liquid and gaseous phase components of two different densities into a resonant volume to generate a flow of the two-phase fluid in the spark gap along the wall.

13. The spark gap switch of claim 2 wherein the liquid component of the two-phase fluid is preferentially adjacent to the wall.

14. A spark gap switch for transferring electrical energy from a source to a load in a series of sparks, comprising:

a pair of electrodes, a dielectric housing, a purge gas inlet and outlet, a tuned unsteady flow channel, defined by a wall and adjacent the spark gap, tuning duct, diffuser and exhaust duct, for producing an unsteady flow of a fluid from the inlet through the spark gap in response to each spark produced by the spark switch; and means for injecting a two-phase purge fluid having liquid and gaseous phase components of two different densities generally tangentially to the wall of the source region to generate a circulating flow of the two-phase fluid in the spark gap along the wall, with the liquid component of the two-phase fluid preferentially adjacent to the wall.

* * * * *